US007594521B2

(12) United States Patent
Vanneste et al.

(10) Patent No.: US 7,594,521 B2
(45) Date of Patent: Sep. 29, 2009

(54) DEVICE FOR DRIVING A WEAVING FRAME IN A WEAVING MACHINE AND A WEAVING MACHINE PROVIDED WITH ONE OR SEVERAL SUCH DEVICES

(75) Inventors: Stéphan Vanneste, Rekkem-Menen (BE); Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 152 days.

(21) Appl. No.: 11/481,408

(22) Filed: Jul. 5, 2006

(65) Prior Publication Data

US 2007/0028990 A1 Feb. 8, 2007

(30) Foreign Application Priority Data

Jul. 5, 2005 (BE) ..... 2005/0338

(51) Int. Cl.

| | |
|---|---|
| ***D03D 51/02*** | (2006.01) |
| ***D03C 1/00*** | (2006.01) |
| ***D03C 5/00*** | (2006.01) |
| *D03D 51/00* | (2006.01) |
| *D03C 13/00* | (2006.01) |

(52) U.S. Cl. ..... 139/55.1; 139/1 E; 139/57; 139/156; 139/328; 139/58

(58) Field of Classification Search ..... 139/1 E, 139/55.1, 57, 156, 328, 58, 91, 62, 66, 76, 139/87, 77, 180, 79, 80, 81, 82
See application file for complete search history.

(56) References Cited

U.S. PATENT DOCUMENTS

| | | | | |
|---|---|---|---|---|
| 1,826,334 | A * | 10/1931 | Wattie | 139/77 |
| 2,130,520 | A * | 9/1938 | Bockius et al. | 156/175 |
| 2,186,814 | A * | 1/1940 | Adams | 66/125 R |
| 3,568,725 | A * | 3/1971 | Hindle et al. | 139/76 |
| 3,680,603 | A * | 8/1972 | Hindle et al. | 139/180 |
| 4,393,902 | A * | 7/1983 | Brock | 139/76 |
| 4,433,704 | A * | 2/1984 | Decuq | 139/66 R |
| 4,518,020 | A * | 5/1985 | Speich | 139/55.1 |
| 5,613,526 | A * | 3/1997 | Palau et al. | 139/59 |
| 6,293,315 | B1 * | 9/2001 | Froment et al. | 139/55.1 |
| 6,357,486 | B2 * | 3/2002 | Braun | 139/59 |
| 6,450,209 | B1 * | 9/2002 | Hirai | 139/57 |
| 2002/0046777 | A1 * | 4/2002 | Hirai | 139/57 |

FOREIGN PATENT DOCUMENTS

| | | |
|---|---|---|
| EP | 1477598 | 11/2004 |
| EP | 1489208 | 12/2004 |

* cited by examiner

*Primary Examiner*—Bobby H Muromoto, Jr.
(74) *Attorney, Agent, or Firm*—James Creighton Wray; Meera P. Narasimhan

(57) ABSTRACT

A device for driving a weaving frame in a weaving machine, comprising a drive with a motor (4) or a geared motor (4, 7), provided with a bearing (10) on its output shaft (9), with an eccentric-shaft (2) and with a driving rod (8), wherein the drive with motor (4) or geared motor (4, 7), with eccentric shaft (2) and with driving rod (8) is provided as a driving module (1) in which the eccentric shaft (2) is supported in an abutment (3) situated in the housing (5) of the driving module (1) on the side of the eccentric shaft (2) away from the motor (4) or the geared motor (4, 7). A weaving machine which is provided with one or several of the devices.

26 Claims, 6 Drawing Sheets

DEVICE FOR DRIVING A WEAVING FRAME IN A WEAVING MACHINE AND A WEAVING MACHINE PROVIDED WITH ONE OR SEVERAL SUCH DEVICES

This application claims the benefit of Belgian Application No. 2005/0338 filed Jul. 5, 2005, which is hereby incorporated by reference in its entirety.

BACKGROUND OF THE INVENTION

The invention relates to a device for driving a weaving frame in a weaving machine, comprising a drive with a motor or a geared motor, provided with a bearing on its output shaft, with an eccentric shaft and with a driving rod. On the other hand, the invention relates to a weaving machine provided with one or several such devices.

When weaving, warp yarns are positioned with respect to weft insertion means in order to realize the shed required to manufacture a specific fabric. Once the warp yarns have taken up their exact positions when forming the shed, the one or several weft insertion means will insert the necessary wefts through the shed which, in turn, will be pushed against the fell of the fabric by the weaving reed. Then the warp yarns will be brought into a next position in order to form the next shed, before inserting one or several new wefts.

As for most fabrics, quite a few warp yarns, have to be brought into the same position across the width of a weaving machine with respect to the weft insertion means, the heddles, through which these warp yarns are extending, are hung in a weaving frame which is driven in order to take up these positions. This applies both to flat fabrics where usually all the warp yarns are involved and to weaving pile fabrics where likewise all the warp yarns can be involved, but where things are usually limited to the backing warp yarns. Driving the weaving frames occurs in such a manner that, after weft insertion, each weaving frame takes up a position with respect to the weft insertion means, such that the warp yarns are forming the new shed required and a new weft may be inserted.

A great number of weave structures are characterized by a positioning pattern of the warp yarns with respect to the weft insertion means which is repeating itself over a limited number of wefts, for instance 2, 4, 6 or 8 shots. The weaving frames being driven here by a cam mechanism, the cam realizing the successive positions of a weaving frame in accordance with one or several positioning patterns which are repeating. By making use of different cams for the different weaving frames or at least positioning the cams for driving the different weaving frames in a different manner with respect to one another, the different weaving frames are taking up different positions in order to form the shed required each time to realize the fabric desired.

In order to drive the weaving frames with a more random positioning pattern, an electronic dobby device may be used. With such a device the dobby device will be able to select any position when forming the shed for any selection, in a manner independent of the preceding one and will also be possible to manufacture fabrics without the repeat pattern mentioned in the positions of the warp yarns.

A further, even more flexible method for driving weaving frames consists in providing each weaving frame with its own separate motor in order to bring the weaving frame, each time, in the position required. This method not only enables a random shed forming pattern to be realized, as when using dobby devices. By driving the motors separately it is also possible to impose a particular trajectory as a function of the time, on each motion of each weaving frame, also during its moving from one position into another. This, among other things, will prevent all the warp yarns of each combination of two weaving frames from crossing at the same moment. For it will be possible to ensure that the warp yarns of two weaving frames will get crossed at some other time than a combination of warp yarns of two other weaving frames will get crossed. Furthermore, in this manner, it will also be possible to open the shed more rapidly or more slowly in order to allow the weft insertion more time or less time per machine cycle, for instance, as a function of the fabric, the weaving speed, the width of the fabric or as a function of the weft yarn. It will also be possible to adjust the trajectory of the weaving frame, by means of certain types of these drives equipped with separate drive motors, or to bring the weaving frames into such a position, that the yarns will be subject to a reduced stress when the machine is stationary.

In the European patent application 1 215 317 a motor arrangement for such a device is described, in which it is made possible to install a considerable number of motors in order to drive a considerable number of weaving frames, each motor output shaft being linked to an eccentric shaft, to which a driving rod is linked, which is connected to a weaving frame by means of levers and rods. The continuously rotating eccentric shaft imposes a rocking motion on the driving rod, which is converted into an up and down movement of the weaving frame by linking the driving rod to the other levers and rods. This arrangement requires motors having a high torque and a quick reaction time, which will render this motors very expensive. Furthermore, the driving rod is no longer supported by bearings outside the motor, so that the reactive forces caused by the tension of the warp yarns on the weaving frame which are transmitted to the eccentric shaft through the connecting bars and levers and the driving rod will end up completely, as a load on the bearings of the drive motor. Because of this, the bearings in the motor on the side of the output shaft will be subjected to an additional heavy load, which may cause them to wear out rapidly and to be of a short operating lifetime.

In the European patent application EP 1 477 598 a solution to this problem is described, in which the installation of cheaper motors mounted on one or several frames of the shed forming device is used, each motor being linked to a reductor on the output shaft, which, in turn, is attached to a frame of a shed forming device and the eccentric output shaft being supported by additional bearings in the frame of the shed forming device on the side away from the motor and the reductor. In this manner, the forces in the bearings are reduced and the load imposed on the motor is likewise reduced, as the motor may be operating at a higher speed and may supply a lower torque, which will be converted by the speed reductor into a lower speed and a higher torque. This will render the device significantly cheaper.

In the European patent application 1 489 208 a device is likewise presented equipped with a geared motor, the motor performing an oscillating motion. It is no longer necessary, that the output shaft on which the driving rod is mounted will be an eccentric shaft. The geared motor also is attached to a frame, the output shaft extending through the frame, where it may be connected to a driving rod. The load, which because of the tension of the warp yarns, is guided to the bearing on this output shaft, through the heddles, the weaving frame, the levers and the driving rods, is a very heavy one for this bearing, as the output shaft is supported by a one-sided bearing only.

For a strong solution concerning motor driven weaving frames at a favorable cost and presenting a long operating lifetime it is important that the output shaft of the motor or the reductor (if installed) is supported by a double-sided bearing arrangement. This will strongly reduce the forces acting on the bearings and will also reduce the deflexion of the output shaft, giving cause to a greater strength and less vibrations. These advantages last-mentioned will become more important the more the two bearings are situated closely one to another.

The solution as proposed in EP 1 477 598 has a double-sided bearing arrangement on the output shaft, but has the disadvantage that attaching the geared motor to the frame of the shed forming device on the one hand, and the bearing arrangement of the eccentric shaft on the other hand, will make high demands on the precision of the frame and the geared motor. Finally, the bearing seat in the frame for the abutment has to be positioned accurately with respect to the bearing seat on the output shaft of the geared motor. For this purpose, the position of the bearing seat in the frame has to be provided very accurately with respect to the fastening elements of the frame where the geared motor has to be attached to the frame on the one hand. On the other hand, the fastening elements of the geared motor to be attached to the frame should be carried out very accurately with respect to the bearing in the geared motor. Finally, the connection between the geared motor and the frame has to be carried out with great precision, for instance, by using dowel pins, so that the precision of the various components should not be counteracted by an inaccurate connection. All this will increase the cost of both frame and geared motor, as well as the installation costs to connect the geared motors to the frame. Furthermore, the fact remains that the bearing seat in the frame is meant to fit a bearing of certain dimensions. When, because of different loads exerted on different weaving frames, the decision should be made to use different geared motors and eccentric shafts with different bearings, such a frame will not allow for weaving frames having different bearings on the eccentric to change positions in their drives.

In case the geared motors are installed on both sides of the frame of the shed forming device, as represented in the FIGS. 1, 2, and 5 of EP 1 477 598, the bearing seats in the frame for the bearings on the eccentric shafts, have to be finished centrally in the frame, which is a complicated and expensive operation. Moreover, both the connection of the eccentric shafts on the output shaft of the geared motor and the bearing arrangement of the eccentric shafts in the frame will require space inside the frame, which will prevent the frame from being made more compact or from driving more weaving frames with the same dimension of the frame. In the embodiments represented in the FIGS. 5, 6, 7 and 10 of EP 1 477 598 the eccentric shafts are of unequal length, which will have a different influence on the behavior of the different weaving frames when operating.

SUMMARY OF THE INVENTION

The purpose of the invention is to provide a device for driving a weaving frame in a weaving machine in accordance with the preamble of the first claim, a device being obtained with a double-sided bearing for driving a weaving frame which will be compact, simple and at a favorable cost price.

This purpose is attained by providing a weaving frame in a weaving machine, comprising a drive with a motor or a geared motor, provided with a bearing on its output shaft, with an eccentric shaft and with a driving rod, the drive with motor or geared motor, with eccentric shaft and with driving rod being carried out as a driving module in which the eccentric shaft is supported by an abutment being situated in the housing of the driving module on the side of the eccentric shaft away from the motor or the geared motor.

In this manner a compact, simple and cost effective device with a double-sided bearing arrangement for driving a weaving frame in a weaving machine is obtained.

In a preferred embodiment of a device according to the invention, the housing of the driving module is provided to be installed on a frame in the weaving machine.

In this manner, the frame can strongly be simplified as its only remaining function is: attachment of the separate driving modules. This attachment now only determines:

- the positioning of the driving rod in the warp direction;
- the positioning of the output shaft of the motor or the geared motor and the eccentric shaft with respect to the weaving frame driven by the driving rod.

The accuracy of both positionings for these two cases may be an order of magnitude less (order of accuracy 0,1 to 0,5 mm) than the positioning of the bearing of the eccentric shaft with respect to the bearing in the motor or the geared motor (order of accuracy 0,01 to 0,05 mm). This means that the requirements for the accuracy of the frame have been significantly reduced which will strongly simplify the frame and will lower the cost price significantly. It will also be possible to realize the driving module with eccentric shaft, abutment and drive shaft at a low price, because the accuracy requirements of the position of the bearings inside the driving module with respect to the fastening elements of the frame are less stringent. The mutual accuracy of the bearing seats with respect to each other is easier and cheaper to be realized with compact driving modules than with larger units such as, for instance, a frame with integrated bearings as made possible by the state-of-the-art.

In a preferred embodiment of a device according to the invention, the frame is consisting of a base plate and an upright wall provided for attaching one or several driving modules to it.

In an advantageous embodiment of a device according to the invention, the driving module with eccentric shaft, the abutment and the driving rod are composed as a preassembled unit, provided to be installed on the frame as a whole.

This is particularly favorable with respect to the cost price and to exchange a driving module for servicing purposes.

For an efficient installation of different driving modules for driving different weaving frames, the device may be provided in the following manners:

- the frame is carried out with different stages in the warp direction, a fastening surface being provided per stage for attaching a driving module. Preferably, in this case the successive fastening surfaces being mutually spaced corresponding with the pitch between two successive weaving frames. By pitch between two successive weaving frames is meant the distance between the front of a weaving frame and the front of the next weaving frame (in the direction away from the weaver);
- the installation of several frames, to each of which driving modules, each driving a weaving frame, with their housing are attached, distributed among both sides of the weaving machine in the weft direction;
- the installation of two frames, to each of which driving modules, each of which driving a weaving frame, with their housings are attached, in the weft direction on one side of the weaving machine, the motors of the driving modules being situated on the outside with respect to both these frames and the eccentric shafts of the driving modules being situated on the inside between the two frames.

In a preferred embodiment according to the invention, one or several frames, to each of which driving modules, each of which driving a weaving frame, with their housings are attached, are each linked to one of the side frames of the weaving machines.

In a preferred embodiment of a device according to the invention, an eccentric shaft is composed of three parts, i.e.:

- a first part realizing the connection to the output shaft of the motor or geared motor;
- a second part situated in a position eccentric with respect to the output shaft of the motor or geared motor and which is supporting the driving rod by means of a bearing;
- a third part which is situated in a coaxial position with respect to the output shaft of the motor or geared motor and which is carrying the abutment.

In a preferred embodiment of a device according to the invention, the output shaft of the motor or the geared motor is carried out with such a large diameter that the greater part of a projection of the second part of the eccentric shaft along the center line of this second part fits inside the cross-section of the output shaft.

In an advantageous embodiment of a device according to the invention, the said first part of the eccentric shaft is carried out as a shaft journal attached in the eccentric recess of the shaft journal of the output shaft of the motor or geared motor and which has a diameter that is smaller than or equal to the diameter of the second part of the eccentric shaft.

This is strongly in favor of the compactness and the strength of the driving module. At the same time, the diameter of the output shaft of the motor or the geared motor is the cause of a larger diameter of the abutment, so that it also produces a better resistance to the forces exerted on the weaving frame by the warp yarns, which are transmitted via the heddles, through the levers and driving rods, to the eccentric shaft and to the motor or geared motor which is resulting in a longer operating lifetime of the abutment.

In a more advantageous embodiment of a device according to the invention, the attachment of the shaft journal in the output shaft of the motor or geared motor occurs by means of one or several bolts which are screwed, at least, into the first and second part of the eccentric shaft into the output shaft of the motor or the geared motor.

In a particular embodiment of a device according to the invention, the projection of the eccentric second part of the eccentric shaft fits entirely inside the cross-section of the output shaft of the motor or the geared motor and the shaft journal forming the first part of the eccentric shaft, has the same diameter as the second part of the eccentric shaft and the first and the second part of the eccentric shaft are concentric.

Because the first and the second part of the eccentric shaft are concentric, the connection with the output shaft of the motor or the geared motor becomes more rigid and more stable.

In an advantageous embodiment of a device according to the invention, the output shaft of the motor or the geared motor is provided with an eccentric shaft journal on which the driving rod is bome.

This means that the first and the second part of the eccentric shaft are integrated into the output shaft of the motor or the geared motor, which enables the device to be made even more compact and stronger.

In a more advantageous embodiment of a device according to the invention, after installation of the driving rod with the bearing on the shaft journal, the third part of the eccentric shaft carrying the abutment is installed by connecting the third part of the eccentric shaft to the eccentric shaft journal on the output shaft.

The first and the second part of the eccentric shaft are connected very rigidly and compactly to the output shaft of the motor or the geared motor and the installation of the third part is significantly simplified by its separate and simple shape.

The abutment carried by the third part of the eccentric shaft, may be externally installed on the third part of the eccentric shaft on the one hand.

On the other hand, the abutment carried by the third part, however, may be fitted into a recess in the third part, the housing or a flange of the housing being provided with a fixed shaft journal carrying the bearing.

Preferably, the said fixed shaft journal on the housing or on a flange on the housing is situated coaxially with respect to the output shaft of the motor or the geared motor.

In this embodiment, the bearing of the motor or of the geared motor and the abutment in the eccentric shaft are situated even more closely to one another, still further limiting the deflection of the eccentric shaft and still further increasing the strength of the driving module. Also the driving module becomes even more compact, which is an advantage when using several driving modules.

When, moreover, the abutment is of the same diameter and has the same properties as the bearing on the output shaft of the motor or the geared motor, and the driving rod is situated centrally between the bearing on the output shaft of the motor or the geared motor and the abutment, the operating lifetime of both bearings will be similar, since both bearings will be subjected to almost the same load.

In a particular embodiment of a device according to the invention, the reductor is consisting of a gearwheel on the output shaft of the motor which is meshing with one or several small planetary gears rotating at high speed, which in turn are meshing with an internal gear which is installed fixedly into or is part of the housing of the driving module.

In a more particular embodiment of a device according to the invention, the small planetary gears rotating at high speed, are built into a planet carrier performing a slowly rotating motion, the planet carrier being the output shaft.

Since the magnitude of this component, the output shaft can be very simply carried out having a large diameter without enlarging the construction of the driving module. Conversely, a reductor with reduction stages, as described above, always has gearwheels situated next to one another, so that most of the time, the external dimensions of the reductor with ordinary stages will be significantly larger than will be the case with a reductor of the planetary type. By means of the planetary reductor a significant speed reduction may be realized with a compact design. Furthermore, the gearwheel on the output shaft will always be smaller when using a reductor with ordinary stages than when using a reductor of the planetary type, so that also the diameter of this output shaft will be much smaller.

In an advantageous embodiment of a device according to the invention, the device is provided with means to determine mechanically the reference point of the drive motor.

In a more advantageous embodiment of a device according to the invention, in an angular position of the eccentric shaft with respect to the housing, considered as a reference position, drilled holes are provided in the flange of the housing, the third part of the eccentric shaft journal and the output shaft of the motor or the geared motor successively.

In order to determine the reference point, preferably the eccentric shaft is provided to be rotated until a dowel pin may be inserted through the drilled hole in the flange, the drilled hole in the third part of the eccentric shaft and the drilled hole in the output shaft successively.

On the other hand, the purpose of the invention is to provide a weaving machine which is provided with a compact, simple and cost effective device with a double-sided bearing for driving the weaving frames in a weaving machine.

This purpose is attained by providing a weaving machine which is provided with one or several devices according to the invention as described above.

The present invention will now be further explained by means of the following detailed description of a device according to the invention. The intention of this description is only to produce an explanatory example and to point out any further advantages and particulars of the present invention and therefore may by no means be interpreted as a restriction of the field of application of the invention or of the patent rights demanded for in the claims.

In this detailed description, by means of reference numbers, reference is made to the attached drawings of which:

DETAILED DESCRIPTION OF THE PREFERRED EMBODIMENTS

Figure 1:
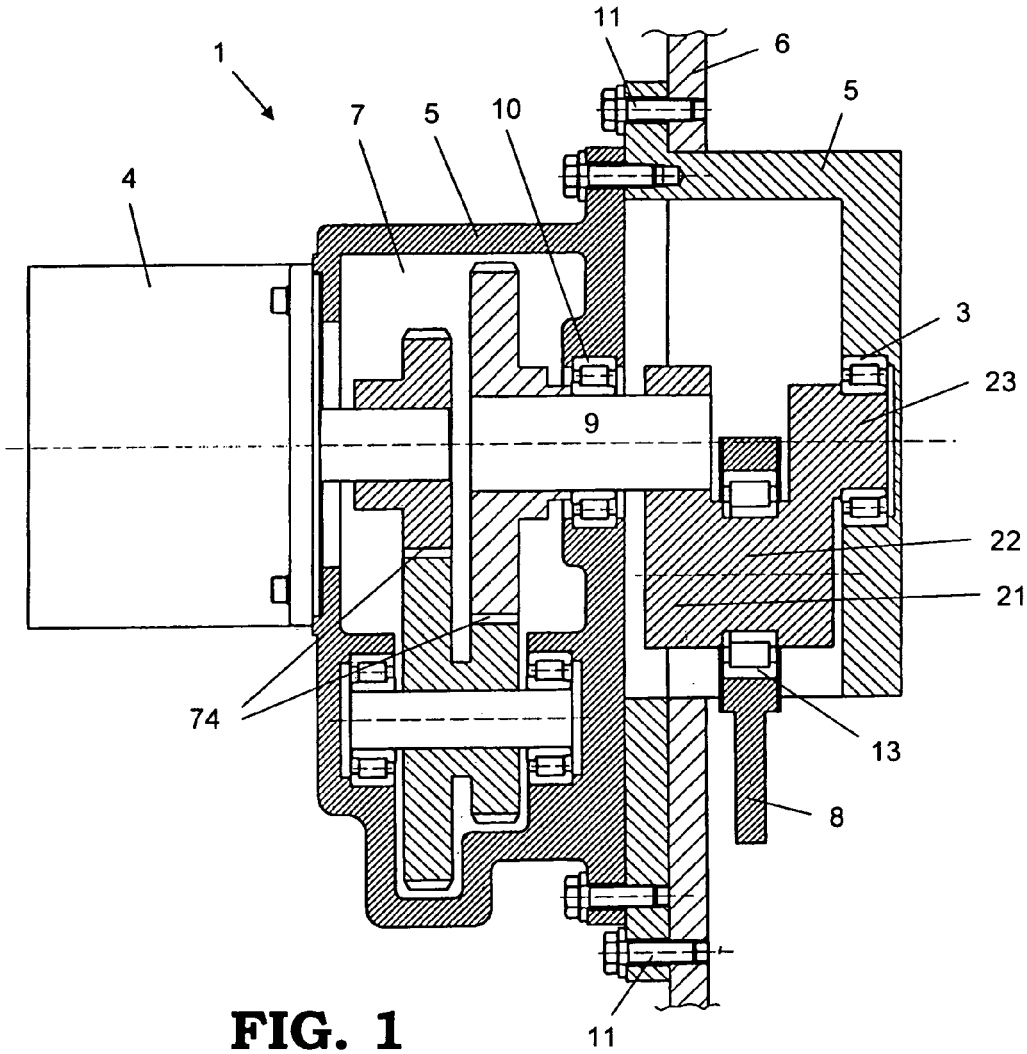
FIG. 1 is representing a driving module according to the invention for driving a weaving frame, which is installed on a frame.

A device for driving a weaving frame in a weaving machine as represented in the FIGS. 1 to 7, is comprising a drive with a motor (4) or a geared motor (4, 7) which is provided with a bearing (10) on its output shaft (9), with an eccentric shaft (2) and with a driving rod (8) which is carried out as a driving module (1) in which the eccentric shaft (2) is supported by an abutment (3) situated in the housing (5) of the driving module (1) on the side of the eccentric shaft (2) away from the motor (4) or the geared motor (4, 7). The housing (5) of the driving module is provided to be installed on a frame (6) in the weaving machine. As represented in the FIGS. 2, 3 and 4, the frame may be provided for several driving modules (1) to be attached to it. For that purpose, the frame (6) may consist of, for instance, a base plate and an upright wall which is provided for one or several driving modules (1) to be attached to it.

A preferred embodiment consists of a driving module (1) with an eccentric shaft (2), a bearing (3) and a driving rod (8) to be composed as a preassembled unit which is provided to be installed on the frame (6) as a whole.

Figure 2:
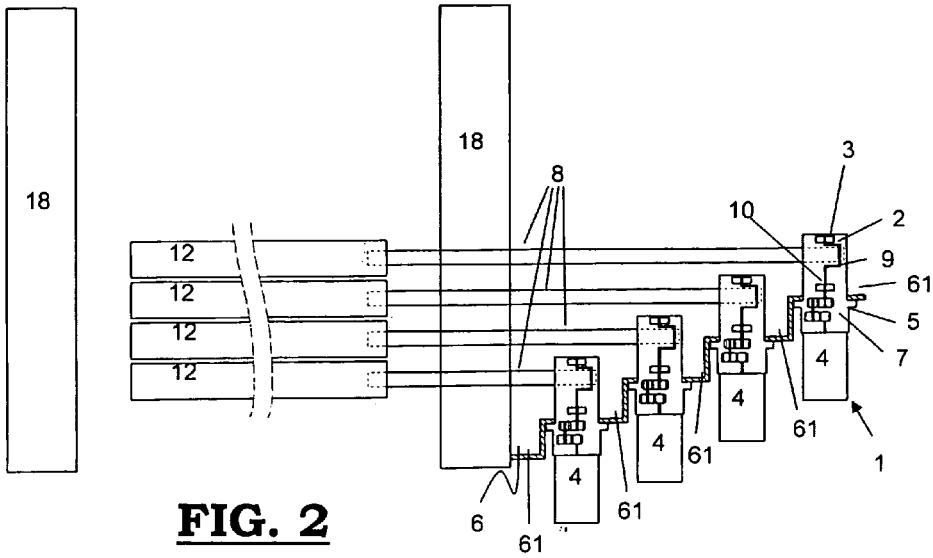
FIGS. 2, 3 and 4 are representing an arrangement of several driving modules according to the invention, each driving module being provided for driving a weaving frame and the driving modules being installed on one or several frames.
Figure 3:
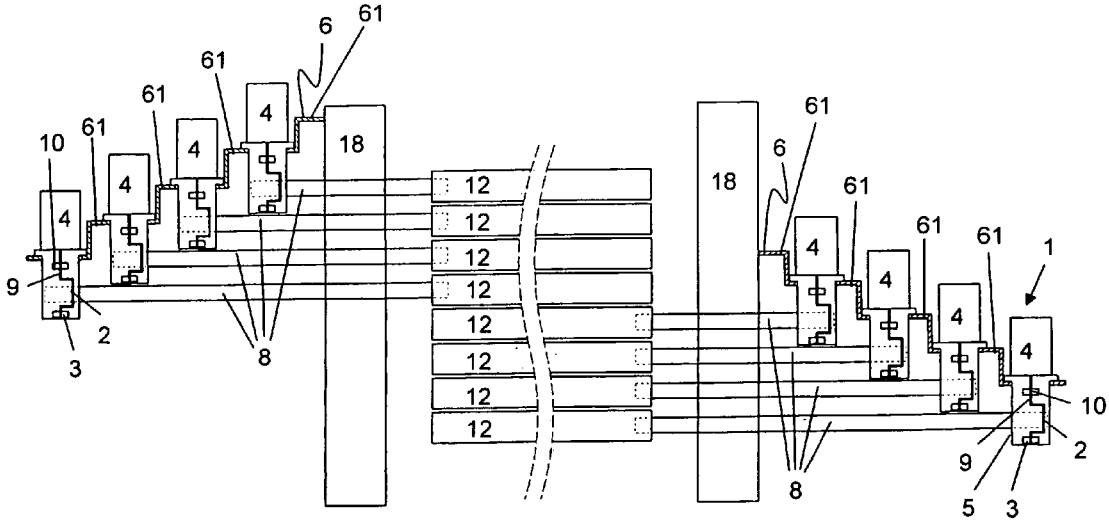
Figure 4:
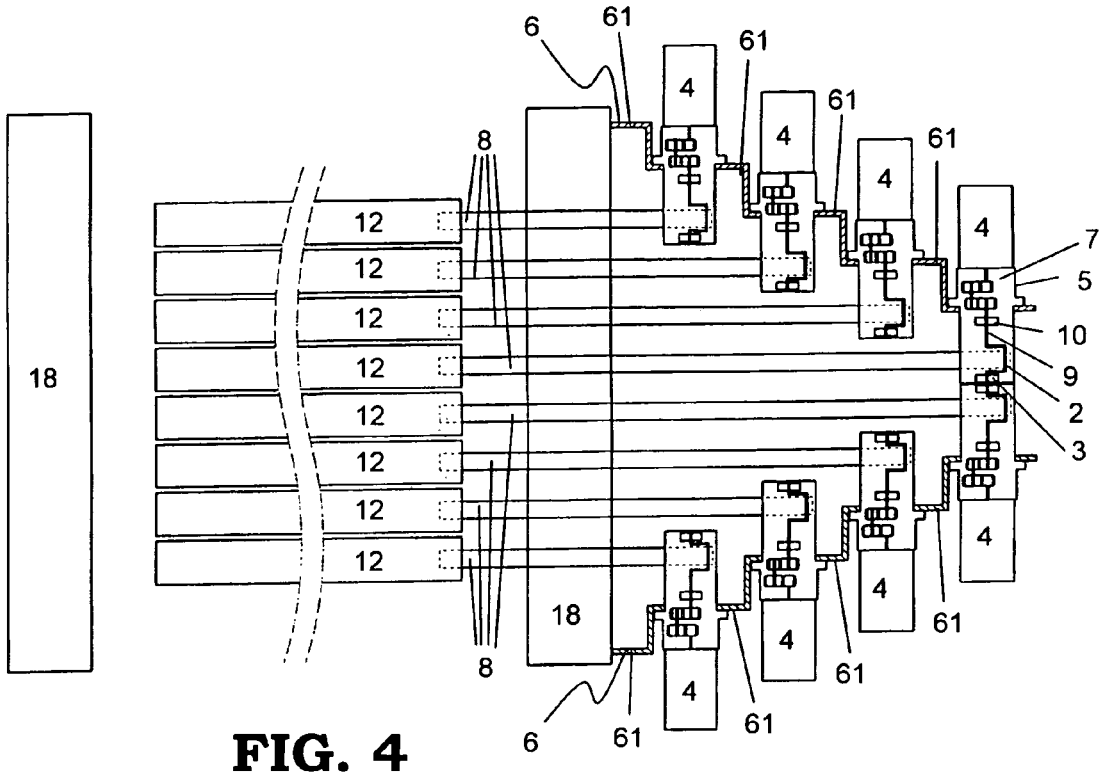

For an efficient installation of different driving modules for driving different weaving frames, as represented in the FIGS. 2, 3 and 4, the device may be provided in the following manners:

- the frame (6) is carried out with different stages in the warp direction, per stage a fastening surface being provided for attaching a driving module (1). The successive fastening surfaces (61), preferably being situated at a mutual distance corresponding to the pitch between two successive weaving frames (12). By pitch between two successive weaving frames (12) the distance is meant between the front of a weaving frame and the front of the next weaving frame (in the direction away from the weaver) (see FIG. 2). The connection between the driving rod (8) and the weaving frame (12) is represented only symbolically. In the manner known, other levers and driving rods may be inserted in order to realize an up and down motion of the weaving frames (12) as known by one skilled in the art;
- several frames (6), to which driving modules (1) are attached with their housing (5), each module driving a weaving frame (12), are installed in the weft direction, distributed among both sides of the weaving machine (see FIG. 3);
- two frames (12) to which driving modules (1) are attached with their housing (5), each driving a weaving frame (12), are installed in the weft direction on one side of the weaving machine, the motors (4) of the driving modules being situated on the outside with respect to both frames (6) and the eccentric shafts (2) of the driving modules (1) being situated on the inside between the two frames (6) (see FIG. 4).

In each of the cases mentioned above, driving modules (1) both with or without reductors (7), or a mix of both types may be used.

For the following, it will be understood, that we consider the eccentric shaft (2) as consisting of three parts (as represented in the FIGS. 1, 5 to 7), i.e.:

- a first part (21) realizing the connection to the output shaft (9) of the motor (4) or the geared motor (4, 7);
- a second part (22) situated in an eccentric position with respect to the output shaft (9) of the motor (4) or the geared motor (4, 7) and is supporting the driving rod (8) by means of a bearing;
- a third part (23) which is situated in a coaxial position with respect to the output shaft (9) of the motor (4) or the geared motor (4, 7) and which is carrying the abutment (3).

Figure 5:
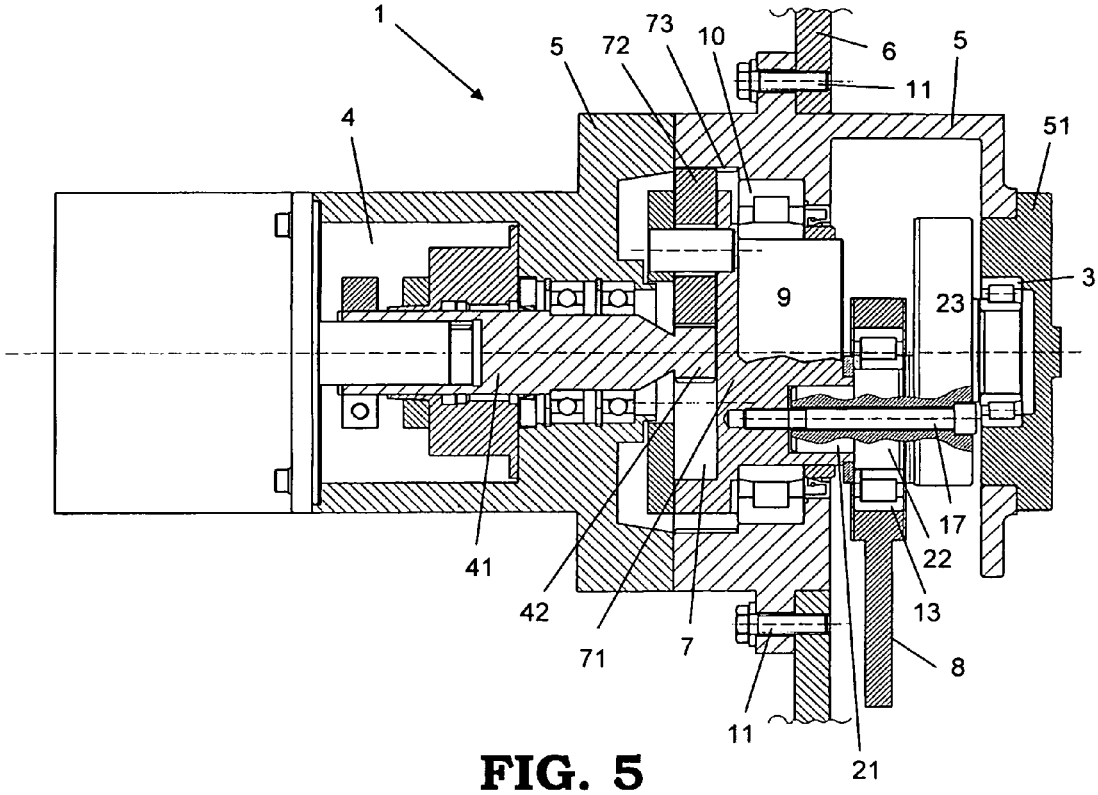
FIGS. 5, 6 and 7 are representing variants of driving modules according to the invention which are provided with a reductor of the planetary type for driving a weaving frame and these driving modules being installed on a frame.
Figure 6:
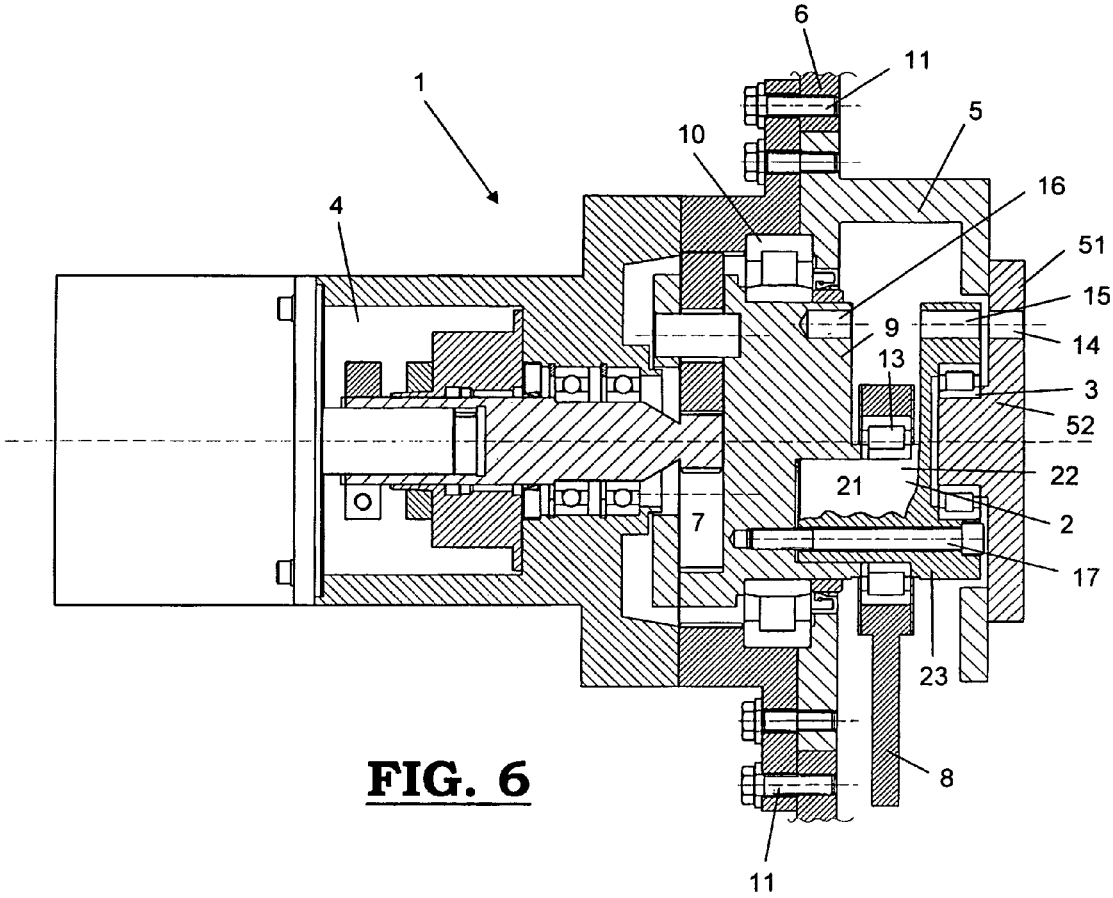

As represented in FIG. 5, the output shaft (9) of the motor (4) or the geared motor (4, 7) may be carried out with such a diameter that the greater part of a projection of the second part (22) of the eccentric shaft (2) along the centre line of this second part (22) will fit inside the cross-section of the output shaft (9). When, as represented in FIG. 5, the first part (21) of the eccentric shaft (2) is carried out as a shaft journal which is attached in an eccentric recess in said large diameter of the output shaft (9) and which has a diameter that is smaller than or equal to the diameter of the second part (22) of the eccentric shaft (2), the second part (22) of the eccentric shaft (2) is very compactly connected to the output shaft (9) of the motor (4) or the geared motor (4,7). In this manner, the said first part (21) of the eccentric shaft (2) may extend partly in the motor (4) or the geared motor (4,7). This will lead to a smaller deflection of the eccentric shaft (2) as a consequence of the forces transmitted by the warp yarns, through heddle, weaving frame (12), levers and driving rods, to the eccentric shaft (2). The connection of the shaft journal (21) in the output shaft (9) of the reductor may occur, for instance, by means of one or several bolts (17) which are screwed into the output shaft (9) of the motor (4) or the geared motor (4, 7), passing through the first part (21) and the second part (22) and, if necessary, through the third part (23) also. As represented in FIG. 6, the projection of the eccentric or second part (22) of the eccentric shaft may fit entirely inside the cross-section of the output shaft (9), and the shaft journal representing the first part (21) has the same diameter as the second part of the eccentric shaft (2) and the first and the second part (21, 22) of the eccentric shaft (2) are concentric.

Figure 7:
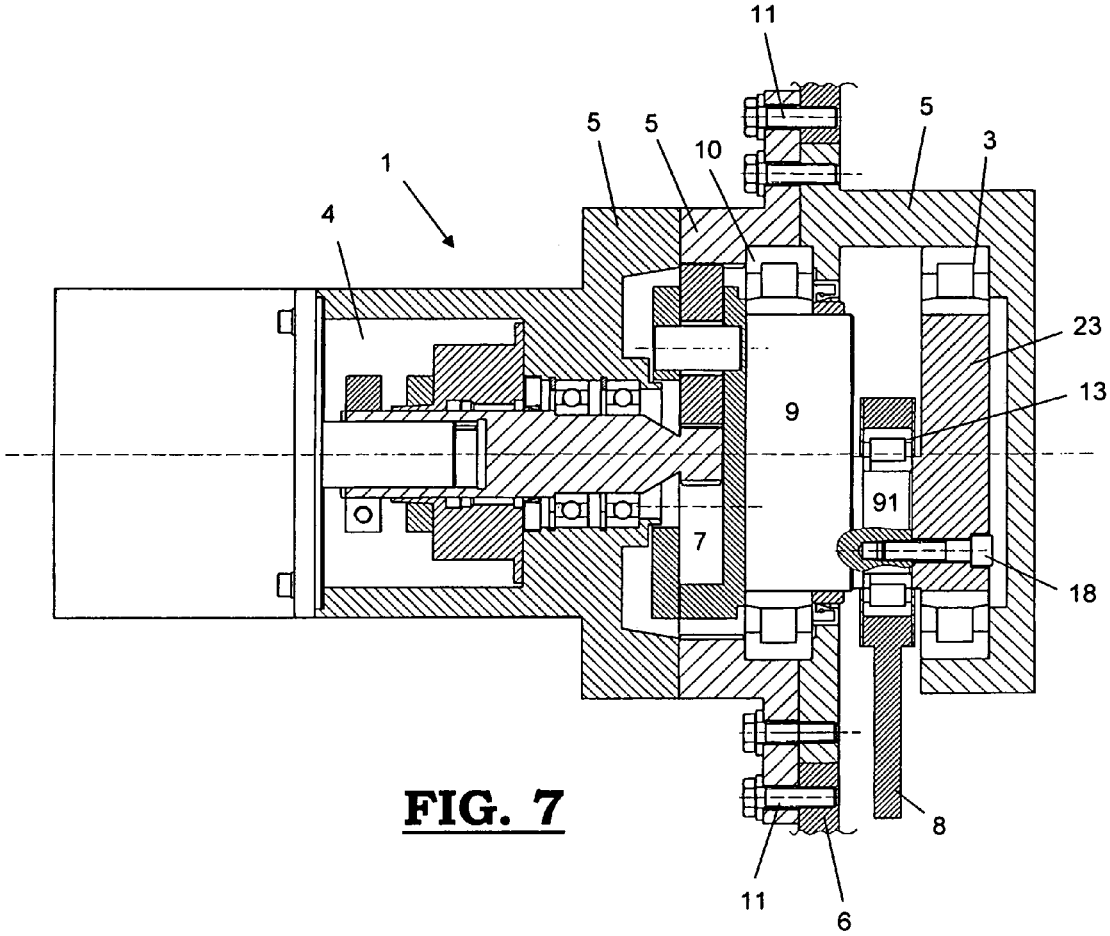

In FIG. 7, the output shaft (9) of the motor (4) or the geared motor (4, 7) is provided with an eccentric shaft journal (91) on which the driving rod (8) is supported by a bearing. Owing to this, the first and the second part (21, 22) of the eccentric shaft (2) are integrated into the output shaft (9) of the motor (4) or the geared motor (4,7). After the driving rod (8) with its bearing (13) has been installed on this shaft journal (91), only the third part (23) of the eccentric shaft (2), carrying the abutment (3), has to be installed by connecting the third part (23) of the eccentric shaft (2) to the shaft journal (91) of the output shaft (9). This may be done, for instance, by connecting the third part (23) to the second part (22) of the eccentric shaft (2) by means of a short bolt (18).

As represented in the FIGS. 1, 5 and 7, the abutment (3) on the third part (23) of the eccentric shaft (2) may be installed externally on this third part (23), and in turn, be incorporated in the housing (5) of the driving module (1). However, the abutment (3), as represented in FIG. 6, may also be fitted into in a recess of the third part (23), the housing (5) or a flange (51) of the housing being provided with a fixed shaft journal (52), fitting into the bearing. This fixed shaft journal (52) of the housing (5) or a flange (51) of the housing is situated in a coaxial position with respect to the output shaft (9) of the motor (4) or the geared motor (4, 7). In case, for the abutment (3) a bearing is chosen having the same dimensions and properties as the bearing (10) on the output shaft (9) of the motor (4) or the geared motor (4, 7), and the driving rod (8) being situated centrally between the bearing (10) and the output shaft (9) of the motor (4) or the geared motor (4, 7) and the abutment (3), the operating lifetime of both bearings will be similar since both bearings are subjected to practically the same load.

As represented in the FIGS. 5 to 7, the reductor (7) of the geared motor (4, 7) may be a planetary one. A gearwheel (42) being provided on the output shaft (41), meshing with one or several small planetary wheels (72) rotating at high speed. These small planetary gears (72) are meshing in turn with an internal gear (73) which is installed fixedly on the housing (5) of the driving module (1) or is part of it. The small planetary gears rotating at high speed (72) are built into a planet carrier (71) performing a slow rotary motion. This planet carrier (71) is the largest moving element in the reductor (7) and is acting as an output shaft (9).

Preferably, the driving module (1) is provided with means in order to determine mechanically the reference point of the motor (4), being part or not of a geared motor (4, 7). To that effect, it is possible, for instance, in an angular position of the eccentric shaft (2), to provide drilled holes (14, 15, 16) considered to be a reference position with respect to the housing, passing through the flange (51) of the housing (5), the third part (23) of the eccentric shaft journal and the output shaft (9) of the motor (4) or the geared motor (4, 7) successively. In order to determine the reference point, the eccentric shaft (2) may be rotated until a dowel pin (not represented in the figures) may be passed through the drilled hole (14) in the flange (51), the drilled hole (15) in the third part (23) of the eccentric shaft (2) and the drilled hole (16) in the output shaft (9) successively. This angular position is then serving as a reference position and may be imposed as such on the rotary measuring system of the driving module (1).

Weaving machines may be equipped with one or several of such driving modules (1) for driving weaving frames (12), part of the weaving frames (12) may also be driven by a cam disc machine, an electronic dobby device or any other shed forming device.

The invention claimed is:

1. Device for driving a weaving frame in a weaving machine, comprising a driving module (1) comprising a drive with a motor (4) or a geared motor (4, 7) including an output shaft (9), a first bearing (10) on the output shaft (9), a housing (5), an abutment (3) in the housing, an eccentric shaft (2) in the housing, a driving rod (8) coupled to the eccentric shaft, said eccentric shaft (2) comprising opposing ends, wherein one end of the eccentric shaft (2) is supported in said first bearing (10) on the output shaft and another end of the eccentric shaft (2) is supported in a second bearing in the abutment (3) situated in the housing (5), and wherein said abutment (3) is disposed on a side of the eccentric shaft (2) away from a side of the eccentric shaft (2) facing the motor (4) or the geared motor (4, 7).

2. Device according to claim 1, characterized in that the housing (5) of the driving module (1) is provided to be installed on a frame (6) in the weaving machine.

3. Device according to claim 2, characterized in that the frame (6) is consisting of a base plate and an upright wall provided for attaching one or several driving modules (1) to it.

4. Device according to claim 2, characterized in that the driving module (1) with eccentric shaft (2), the abutment (3) and the driving rod (8) are composed as a preassembled unit, being provided to be installed on the frame as a whole.

5. Device according to claim 2, characterized in that the driving of the frame (6) is carried out with different stages in the warp direction, and further comprising a fastening surface (61) being provided per stage for attaching the driving module (1).

6. Device according to claim 5, characterized in that the successive fastening surfaces (61) are situated at a mutual distance corresponding to the pitch between two successive weaving frames (12).

7. Device according to claim 2, characterized in that several frames (6), to each of which are attached driving modules (1), each driving a weaving frame (12), with their housings (5), are installed in the weft direction distributed among both sides of the weaving machine.

8. Device according to claim 2, characterized in that two frames (6), to each of which are attached driving modules (1), each of which driving a weaving frame, with their housings (5), are installed in the weft direction on one side of the weaving machine, the motors (4) of the driving modules (1) being situated on the outside with respect to both these frames (6) and the eccentric shafts (2) of the driving modules (1) being situated on the inside between the two frames (6).

9. Device according to claim 2, characterized in that one or several frames (6), to each of which driving modules (1), each of which driving a weaving frame, with their housings (5) are attached, are each connected to one of the side frames of the weaving machine.

10. Device according to claim 1, characterized in that the eccentric shaft (2) is composed of three parts, i.e.

- a first part (21) realizing the connection to the output shaft (9) of the motor (4) or the geared motor (4, 7);
- a second part (22) situated in an eccentric position with respect to the output shaft (9) of the motor (4) or the geared motor (4, 7) and which is supporting the driving rod (8) by means of a bearing;
- a third part (23) which is situated in a coaxial position with respect to the output shaft (9) of the motor (4) or the geared motor (4, 7) and which is carrying the abutment (3).

11. Device according to claim 1, characterized in that the eccentric shaft (2) is composed of three parts, i.e.

a first part (21) realizing the connection to the output shaft (9) of the motor (4) or the geared motor (4, 7);

a second part (22) situated in an eccentric position with respect to the output shaft (9) of the motor (4) or the geared motor (4, 7) and which is supporting the driving rod (8) by means of a bearing;

a third part (23) which is situated in a coaxial position with respect to the output shaft (9) of the motor (4) or the geared motor (4, 7) and which is carrying the abutment (3), characterized in that the output shaft (9) of the motor (4) or the geared motor (4, 7) is carried out with such a large diameter that the greater part of a projection of the second part (22) of the eccentric shaft (2) along the center line of this second part (22) fits inside the cross-section of the output shaft (9).

12. Device according to claim 1 characterized in that the said first part (21) of the eccentric shaft (2) is carried out as a shaft journal attached in an eccentric recess of the shaft journal of the output shaft (9) of the motor (4) or geared motor (4, 7) and which has a diameter that is smaller than or equal to the diameter of the second part (22) of the eccentric shaft (2).

13. Device according to claim 12, characterized in that the attachment of the shaft journal (21) in the output shaft (9) of the motor (4) or geared motor (4, 7) occurs by means of one or several bolts (17) which are screwed, at least, into the first and second part (21, 22) of the eccentric shaft (2) into the output shaft (9) of the motor (4) or the geared motor (4, 7).

14. Device according to claim 1, characterized in that the eccentric shaft (2) is composed of three parts, i.e.

a first part (21) realizing the connection to the output shaft (9) of the motor (4) or the geared motor (4, 7);

a second part (22) situated in an eccentric position with respect to the output shaft (9) of the motor (4) or the geared motor (4, 7) and which is supporting the driving rod (8) by means of a bearing;

a third part (23) which is situated in a coaxial position with respect to the output shaft (9) of the motor (4) or the geared motor (4, 7) and which is carrying the abutment (3), characterized in that the projection of the eccentric second part (22) of the eccentric shaft (2) entirely fits inside the cross-section of the output shaft (9) of the motor (4) or the geared motor (4, 7), and the shaft journal forming the first part (21) of the eccentric shaft (2) has the same diameter as the second part (22) of the eccentric shaft (2) and the first and the second part (21, 22) of the eccentric shaft (2) are concentric.

15. Device according to claim 1, characterized in that the eccentric shaft (2) is composed of three parts, i.e.

a first part (21) realizing the connection to the output shaft (9) of the motor (4) or the geared motor (4, 7);

a second part (22) situated in an eccentric position with respect to the output shaft (9) of the motor (4) or the geared motor (4, 7) and which is supporting the driving rod (8) by means of a bearing;

a third part (23) which is situated in a coaxial position with respect to the output shaft (9) of the motor (4) or the geared motor (4, 7) and which is carrying the abutment (3), characterized in that the output shaft (9) of the motor (4) or the geared motor (4, 7) is provided with an eccentric shaft journal (91) on which the driving rod (8) is borne.

16. Device according to claim 15, characterized in that after installation of the driving rod (8) with the bearing (13) on the shaft journal (91), the third part (23) of the eccentric shaft (2) carrying the abutment (3) is installed by connecting the third part (23) of the eccentric shaft (2) to the eccentric shaft journal (91) on the output shaft (9).

17. Device according to claim 1, characterized in that the eccentric shaft (2) is composed of three parts, i.e.

a first part (21) realizing the connection to the output shaft (9) of the motor (4) or the geared motor (4, 7);

a second part (22) situated in an eccentric position with respect to the output shaft (9) of the motor (4) or the geared motor (4, 7) and which is supporting the driving rod (8) by means of a bearing;

a third part (23) which is situated in a coaxial position with respect to the output shaft (9) of the motor (4) or the geared motor (4, 7) and which is carrying the abutment (3), characterized in that the abutment (3) carried by the third part (23) of the eccentric shaft (2) is installed externally on the third part (23) of the eccentric shaft (2).

18. Device according to claim 1, characterized in that the eccentric shaft (2) is composed of three parts, i.e.

a first part (21) realizing the connection to the output shaft (9) of the motor (4) or the geared motor (4, 7);

a second part (22) situated in an eccentric position with respect to the output shaft (9) of the motor (4) or the geared motor (4, 7) and which is supporting the driving rod (8) by means of a bearing;

a third part (23) which is situated in a coaxial position with respect to the output shaft (9) of the motor (4) or the geared motor (4, 7) and which is carrying the abutment (3), characterized in that the abutment (3) carried by the third part (23) is fitted into a recess in the third part (23), the housing (5) or a flange of the housing (5) being provided with a fixed shaft journal (52) carrying the bearing (3).

19. Device according to claim 18, characterized in that the said fixed shaft journal (52) on the housing (5) or on a flange (51) on the housing (5) is situated coaxially with respect to the output shaft (9) of the motor (4) or the geared motor (4, 7).

20. Device according to claim 18, characterized in that the abutment (3) has the same diameter and the same properties as the bearing (10) on the output shaft (9) of the motor (4) or the geared motor (4, 7) and the driving rod (8) is situated centrally between the bearing (10) on the output shaft (9) of the motor (4) or the geared motor (4, 7) and the abutment (3).

21. Device according to claim 1, characterized in that the geared motor (4, 7) comprises a gearwheel (42) on the output shaft (9) of the motor (4) which is meshing with one or several small planetary gears (72) rotating at high speed, which in turn are meshing with an internal gear (73) which is installed fixedly into or is part of the housing (5) of the driving module (1).

22. Device according to claim 21, characterized in that the small planetary gears (72) rotating at high speed are built into a planet carrier (71) performing a slow rotary motion, the planet carrier being the output shaft.

23. Device according to claim 10, characterized in that the device is provided with means to determine mechanically the reference point of the drive motor (4).

24. Device according to claim 10, characterized in that the device is provided with means to determine mechanically the reference point of the drive motor (4), and in that in an angular position of the eccentric shaft (2) with respect to the housing (5), considered as a reference position, drilled holes (14, 15, 16) are provided in the flange (51) of the housing (5), the third part (23) of the eccentric shaft journal (21) and the output shaft (9) of the motor (4) or the geared motor (4, 7) successively.

25. Device according to claim 10, characterized in that the device is provided with means to determine mechanically the reference point of the drive motor (4), and in that in order to determine the reference point, the eccentric shaft (2) is provided to be rotated until a dowel pin is inserted through the drilled hole (14) in the flange (51), the drilled hole (15) in the third part (23) of the eccentric shaft (2) and the drilled hole (16) in the output shaft (9) successively.

26. Weaving machine, characterized in that the weaving machine is provided with one or several devices for driving a weaving frame in the weaving machine, comprising a driving module (1) comprising a drive with a motor (4) or a geared motor (4, 7) including an output shaft (9), a first bearing (10) on the output shaft (9), a housing (5), an abutment (3) in the housing, an eccentric shaft (2) in the housing, a driving rod (8) coupled to the eccentric shaft, said eccentric shaft (2) comprising opposing ends, wherein one end of the eccentric shaft (2) is supported in said first bearing (10) on the output shaft and another end of the eccentric shaft (2) is supported in a second bearing in the abutment (3) situated in the housing (5), and wherein said abutment (3) is disposed on a side of the eccentric shaft (2) away from a side of the eccentric shaft (2) facing the motor (4) or the geared motor (4, 7).

* * * * *